US005268047A

United States Patent [19]

Chuang

[11] Patent Number: 5,268,047

[45] Date of Patent: Dec. 7, 1993

[54] METHOD OF PRODUCING A TOILET ASSEMBLY

[76] Inventor: M. J. Chuang, Chang-Chin N Road, Taipei, Taiwan

[21] Appl. No.: 865,841

[22] Filed: Apr. 9, 1992

[51] Int. Cl.[5] ..... C04B 33/34

[52] U.S. Cl. ..... 156/89; 4/430; 264/62

[58] Field of Search ..... 156/89; 264/57, 60, 264/86, 87, 62; 4/428, 430

[56] References Cited

U.S. PATENT DOCUMENTS

| | | | |
|---|---|---|---|
| 3,405,203 | 10/1968 | Derror | 264/86 |
| 3,461,194 | 8/1969 | Alexander | 264/86 |
| 3,812,229 | 5/1974 | Anderson | 264/86 |
| 5,067,181 | 11/1991 | Hafner et al. | 4/430 |

*Primary Examiner*—Jan H. Silbaugh
*Assistant Examiner*—Christopher A. Fiorila
*Attorney, Agent, or Firm*—Bacon & Thomas

[57] ABSTRACT

A toilet assembly is produced by molding a plurality of identical toilet bowls and a plurality of different drain pipes which are connected to the toilet bowls to produce toilet assemblies capable of being utilized for different drain outlet locations.

1 Claim, 3 Drawing Sheets

METHOD OF PRODUCING A TOILET ASSEMBLY

BACKGROUND OF THE INVENTION

1. Field of the Invention

The present invention relates to a method of producing a toilet assembly for different drain outlet applications.

2. Description of the Prior Art

In the progress of society, the quality of housing and buildings is seen to improve. Even toilet assemblies, which have heretofore been substantially neglected in design improvements, are now being offered in different styles. Accordingly, different models of toilet assemblies are commercially available with various specifications.

A conventional toilet assembly is an integral structure of a toilet bowl and a drainpipe. While the outward appearances of conventional toilet assemblies are similar, different molds of various sizes are required for producing the various models with different specifications. Because the toilet bowl and drainpipe are integrally molded together, any defect of the product during the production process requires that the entire toilet assembly be discarded. This situation adds considerable costs to the production process because different molds are required and the necessity of discarding an entire assembly, notwithstanding the location of a defect, since the toilet bowl and drainpipe comprise an integral structure.

SUMMARY OF THE INVENTION

The above disadvantages of conventional toilet assembly production are overcome through the present invention which provides a method of producing toilet assemblies for different drain outlet applications in an economical and efficient manner. This is realized by providing a single mold for producing a plurality of identical toilet bowls. A plurality of different molds are utilized for producing drainpipes of different sizes. The different drainpipes are joined to the toilet bowls to form completed toilet assemblies which are thereafter air-seasoned, glazed, and kilned to complete the production process. If the molded toilet bowl or a drainpipe is defective during the production process, it is only necessary to discard the defective part and not the completed assembly, thus assuring higher quality control in the finished products and minimizing costs of discarded defective parts. Moreover, the need for only a single mold to produce identical toilet bowls provides considerable savings over conventional methods which require complete separate molds for producing integral toilet assemblies.

The foregoing disadvantages of conventional toilet assemblies are overcome through the present invention which provides a method of producing a toilet assembly for different drain outlet applications in a cost effective manner. This is realized by molding identical toilet bowls and joining molded drainpipes of different sizes to the bowls to produce assemblies for different drain outlet applications.

Therefore, it is the first object of the present invention to provide a method of producing a toilet assembly by connecting toilet bowls of a fixed size to drainpipes of different sizes, thereby decreasing the conventional costs of molding integral toilet assemblies.

A further object of the present invention is to provide a method of producing a toilet assembly which is cost effective in that any manfacturing defect in either the toilet bowl or drainpipe only requires discarding the effective component rather than the completed toilet assembly.

Other objects, advantages of the invention will become apparent from the following detailed description of a preferred embodiment thereof, when taken in conjunction with the drawings wherein like reference characters refer to corresponding parts in the different views.

BRIEF DESCRIPTION OF THE DRAWINGS

FIG. 2A is a cross-sectional configuration showing the manner in which a drainpipe is joined to the vertical drop of the toilet bowl drain outlet in the practice of the invention.

DETAILED DESCRIPTION OF THE INVENTION

Figure 1:
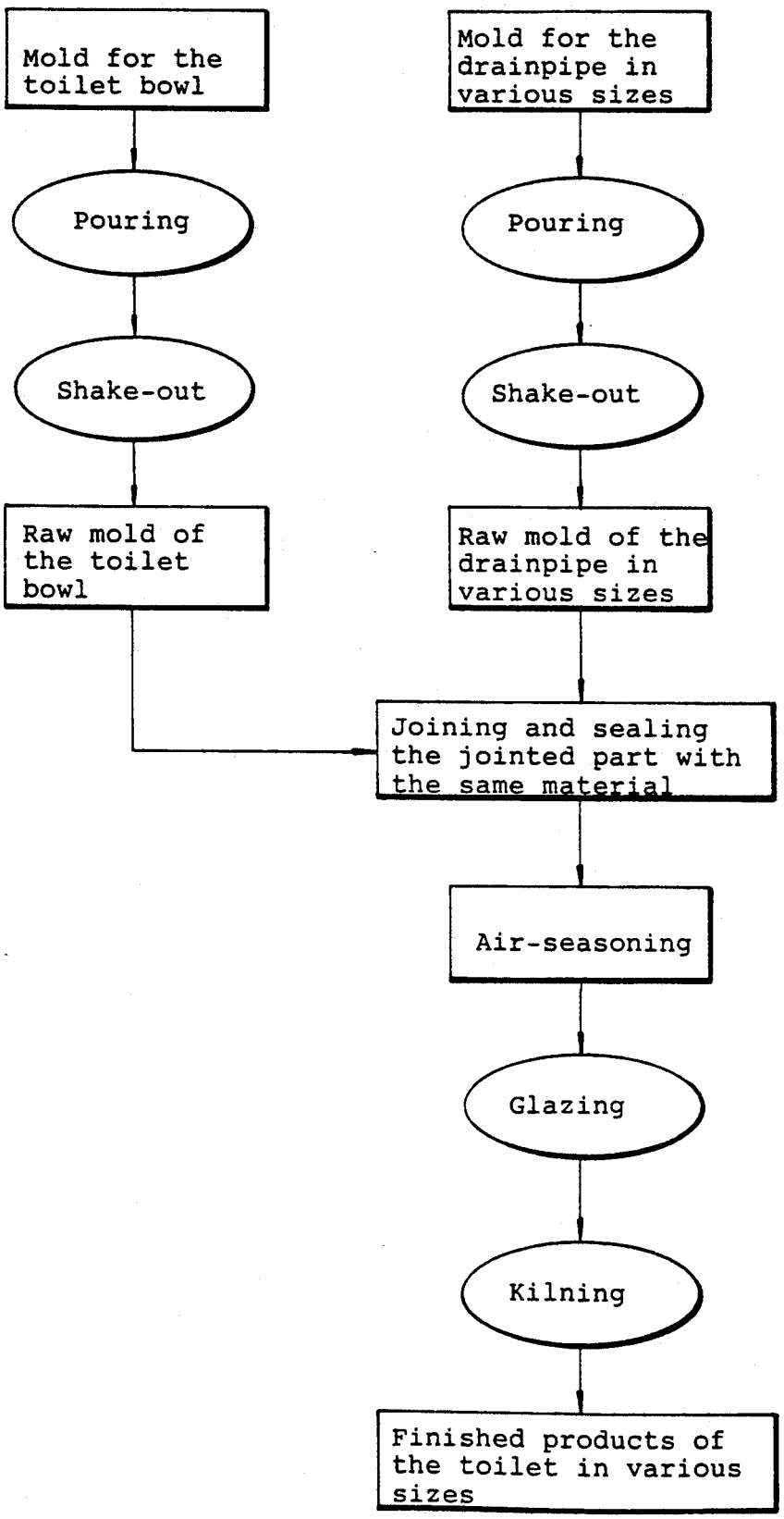
FIG. 1 is a flow chart showing the method steps of the present invention.

As shown in FIG. 1, the first step of the present invention is to pour the argil paste into the molds for molding the toilet bowl and the drainpipe. The toilet bowl mold is a single mold which produces identical molds, while the drainpipe mold includes plural molds which produce drainpipes of different sizes. The raw molded identical toilet bowls and the raw molded drainpipes of different sizes are formed after the shake-out of the molds. The vertical drain drop of each toilet bowl is connected to a drainpipe of a desired size, with the connection joint being thereafter sealed from the exterior with the same argil paste material used in molding the toilet bowl and drainpipe. Though the hole size of the draining outlet of the toilet bowl is fixed, the length of the drainpipe can be extended or shortened during the molding process in accordance with the specifications of the different molds. Thereafter, the joined toilet bowl and drainpipe are air-seasoned, followed by glazing and kilning to produce the finished toilet assembly product. Thus, the completed assemblies differ in drainpipe sizes for different specifications and applications of use.

Figure 2:
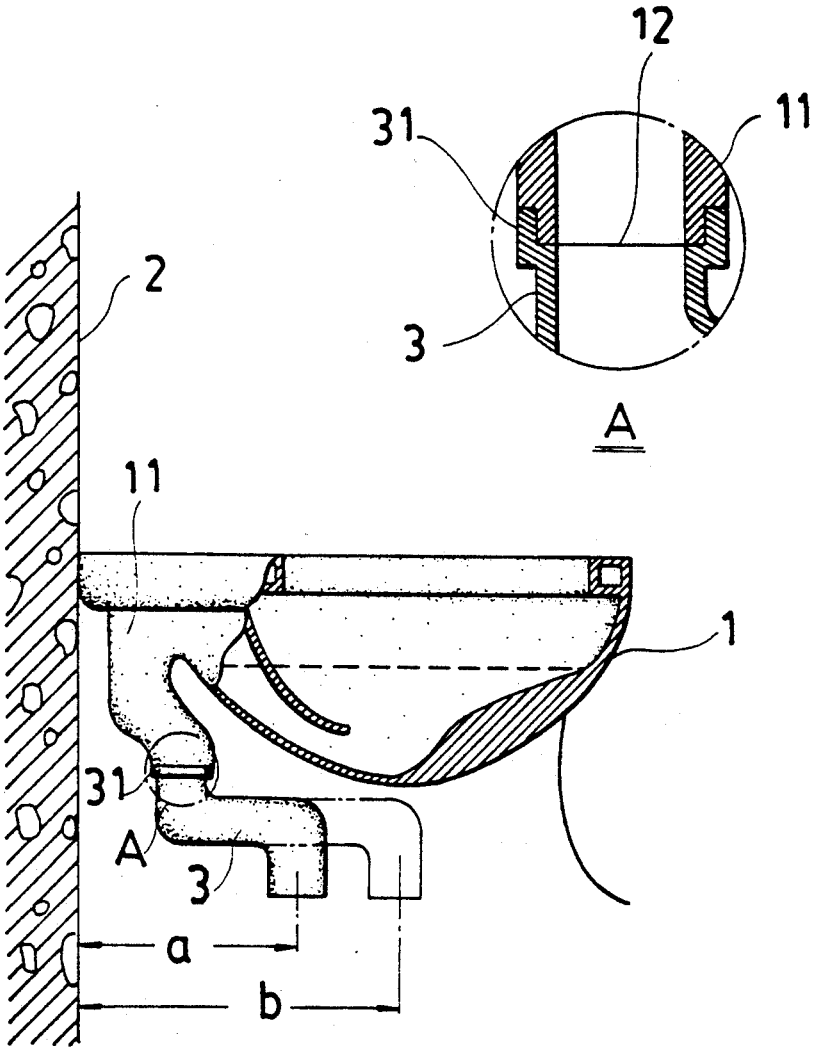
FIG. 2 is a side view, partly in section, showing a toilet assembly made according to the present invention with two drainpipes having different specifications.

With reference to FIG. 2, there is shown the application of toilet assemblies produced by the method of the invention for use in toilet rooms having different drain outlet specifications. The distance between the terminal end of a draining outlet 11 of a toilet bowl 1 and a wall 2 may differ for different toilet rooms, as indicated by the distances designated "a" and "b" which, for example, may be 30 and 40 cm, respectively. In all cases, the size of toilet bowl 1 remains the same. However, in order to have sufficient flushing pressure at the vertical drop 12 of the joint between toilet bowl 1 and a drainpipe 3, as shown in FIG. 2A, drainpipes 3 of different sizes may be utilized as required. As exemplified in FIG. 2, a shorter drainpipe 3 may be used for the shorter distance "a" between the terminal end of draining outlet 11 and wall 2, while a longer drainpipe (shown in phantom) is used for a longer distance "b" between wall 2 and the terminal end of draining outlet 11.

It is important to note that toilet bowl 1 and drainpipe 3 are each molded separately and subsequently connected together during the production process to form a toilet bowl assembly having a predetermined size for drainpipe 3. In this manner, a plurality of such assemblies with different size drainpipes may be produced for different applications of use. A distinct advantage of the invention is the requirement of only a single mold for producing the toilet bowl, while several different molds are used for producing the drainpipes of different sizes. During the production process, any defective toilet bowls 1 and any defective drainpipes 3 may be discarded prior to the joining of a toilet bowl 1 with a given drainpipe 3, thus significantly reducing production costs for defective products. This is in contrast to the conventional method of integrally molding a toilet bowl and drainpipe together, wherein any defect in the production of the integrated assembly requires discarding the entire assembly.

Figure 3:
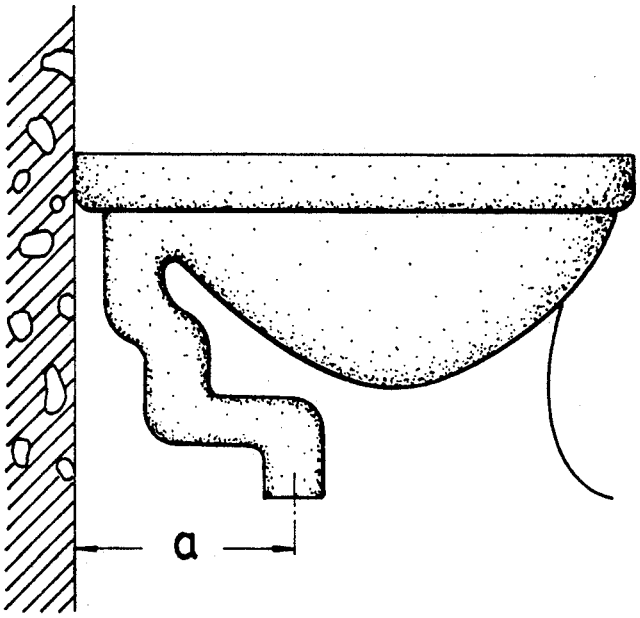
PRIOR ART Fig. 3
FIG. 3 is a side view of a conventional integral toilet assembly.
Figure 4:
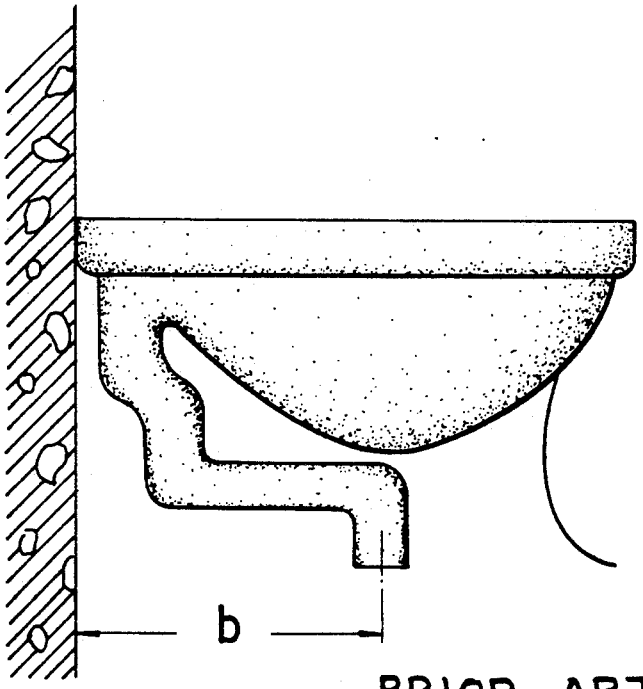
PRIOR ART Fig. 4
FIG. 4 is a side view of another conventional integral toilet assembly.

With reference to FIGS. 3 and 4, there are depicted conventional toilet bowl assemblies having different size integral drainpipes.

I claim:

1. A method of producing toilet assemblies having different size drainpipes comprising the steps of:

a) providing a common mold for molding identical toilet bowls and a plurality of different molds for molding a plurality of drainpipes in different sizes;

b) molding a plurality of identical toilet bowls from argil paste in the common mold and a plurality of drainpipes from argil paste in the different molds;

c) joining the identical molded toilet bowls with the different molded drainpipes;

d) sealing the joint between each toilet bowl and drainpipe from the exterior thereof with argil paste to form a plurality of molded toilet bowl assemblies;

e) air-seasoning the molded toilet bowl assemblies;

f) glazing the air-seasoned molded toilet bowl assemblies; and g) kilning the glazed molded toilet assemblies to produce finished toilet bowl assemblies having drainpipes of different sizes.

* * * * *